US008033968B2

(12) United States Patent
Chen et al.

(10) Patent No.: US 8,033,968 B2
(45) Date of Patent: Oct. 11, 2011

(54) MULTI-FUNCTIONAL YOGA BRICK

(75) Inventors: Hong-Chi Chen, Taipei (TW); Chun-Chi Hsu, Taipei (TW)

(73) Assignee: Orange Star International Co., Ltd, Xinyi Dist. Taipei (TW)

( * ) Notice: Subject to any disclaimer, the term of this patent is extended or adjusted under 35 U.S.C. 154(b) by 0 days.

(21) Appl. No.: 12/578,581

(22) Filed: Oct. 13, 2009

(65) Prior Publication Data

US 2010/0240509 A1 Sep. 23, 2010

(51) Int. Cl.
*A63B 71/00* (2006.01)

(52) U.S. Cl. ..... 482/141; 482/148; 482/907

(58) Field of Classification Search ..... 482/141, 482/148, 907; D21/399, 797; 5/637–640, 5/643, 645; 446/124; 52/606–607
See application file for complete search history.

(56) References Cited

U.S. PATENT DOCUMENTS

| | | | | |
|---|---|---|---|---|
| 4,039,185 | A * | 8/1977 | Rhodes | 273/451 |
| 7,156,791 | B2 * | 1/2007 | Edwards | 482/148 |
| 2004/0192523 | A1 * | 9/2004 | Wu | 482/148 |
| 2007/0219076 | A1 * | 9/2007 | Axelrod | 482/148 |
| 2009/0023563 | A1 * | 1/2009 | Liang | 482/106 |

* cited by examiner

*Primary Examiner* — Rinaldi Rada
*Assistant Examiner* — Andrew M Tecco

(57) ABSTRACT

A multi-functional yoga brick comprises a multi-sectional holding portion at a middle section thereof. The holding portion has a shape of "8", or a round shape or an elliptical shape. The holding portion has a through hole or no through hole. The holding portion has a plurality of layers. The multi-functional yoga brick is an elastic body. The multi-functional yoga brick is made of elastic plastics or rubber or injected plastic material. The user has a better balance in exercise and can support effectively so as to expand the body.

3 Claims, 16 Drawing Sheets

MULTI-FUNCTIONAL YOGA BRICK

FIELD OF THE INVENTION

The present invention relates to yoga exercise, and particularly to a multi-functional yoga brick having a multi-sectional holding portion for being held by users.

BACKGROUND OF THE INVENTION

Yoga brick is used to help the yoga exercise. It is mainly used for retaining, supporting and balancing the body. When a user makes yoga exercise, he (or she) often retains at a fixed pose. At this moment, the yoga brick can be used as a supporter for expanding the body with a great extent. Current yoga brick has a rectangular shape and is not suitable for being held by a hand. Thus, it is possible that the hand's bone will release to hurt the user. Thus, there is an eager demand for a novel one which can improve these defects to help the exerciser to make yoga exercise effectively.

SUMMARY OF THE INVENTION

The object of the present invention is to provide a multi-functional yoga brick so that the user has a better balance in exercise and can support effectively so as to expand the body.

To achieve above object, the present invention provides a multi-functional yoga brick, comprising a multi-sectional holding portion at a middle section thereof. The holding portion has a shape of "8", or a round shape or an elliptical shape. The holding portion has a through hole or no through hole. The holding portion has a plurality of layers. The multi-functional yoga brick is an elastic body. The multi-functional yoga brick is made of elastic plastics or rubber or injected plastic material.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
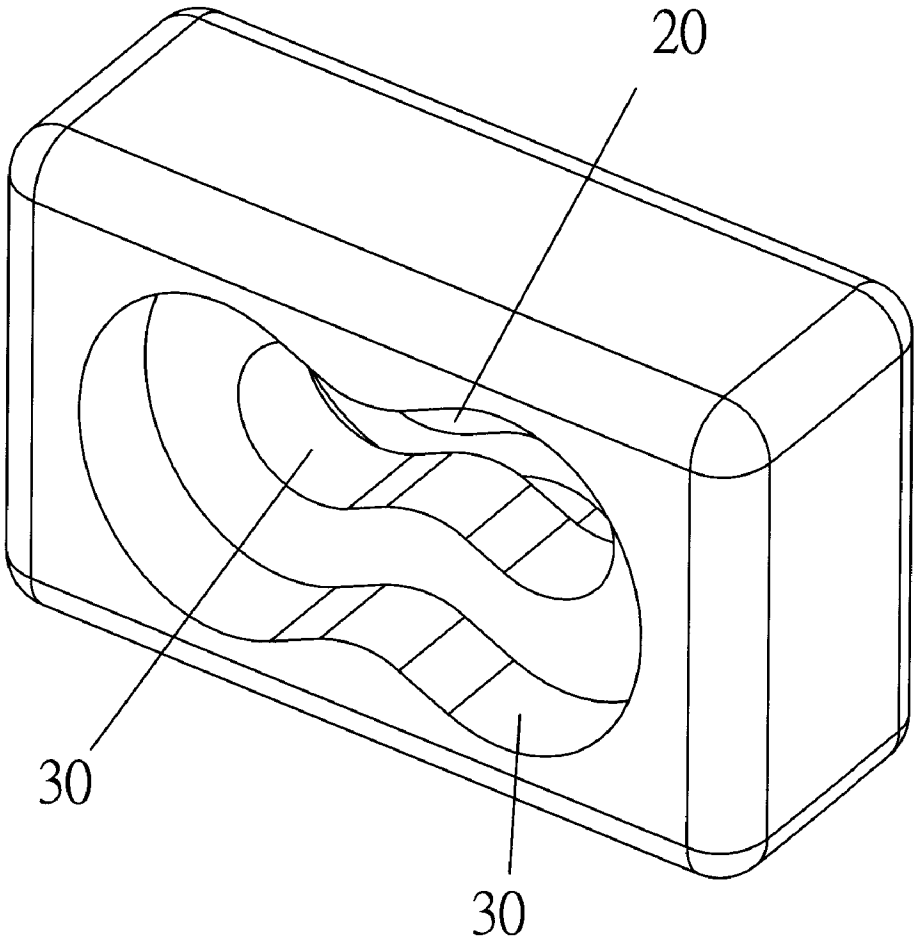
FIG. 1 is a perspective view of the present invention.
Figure 2:
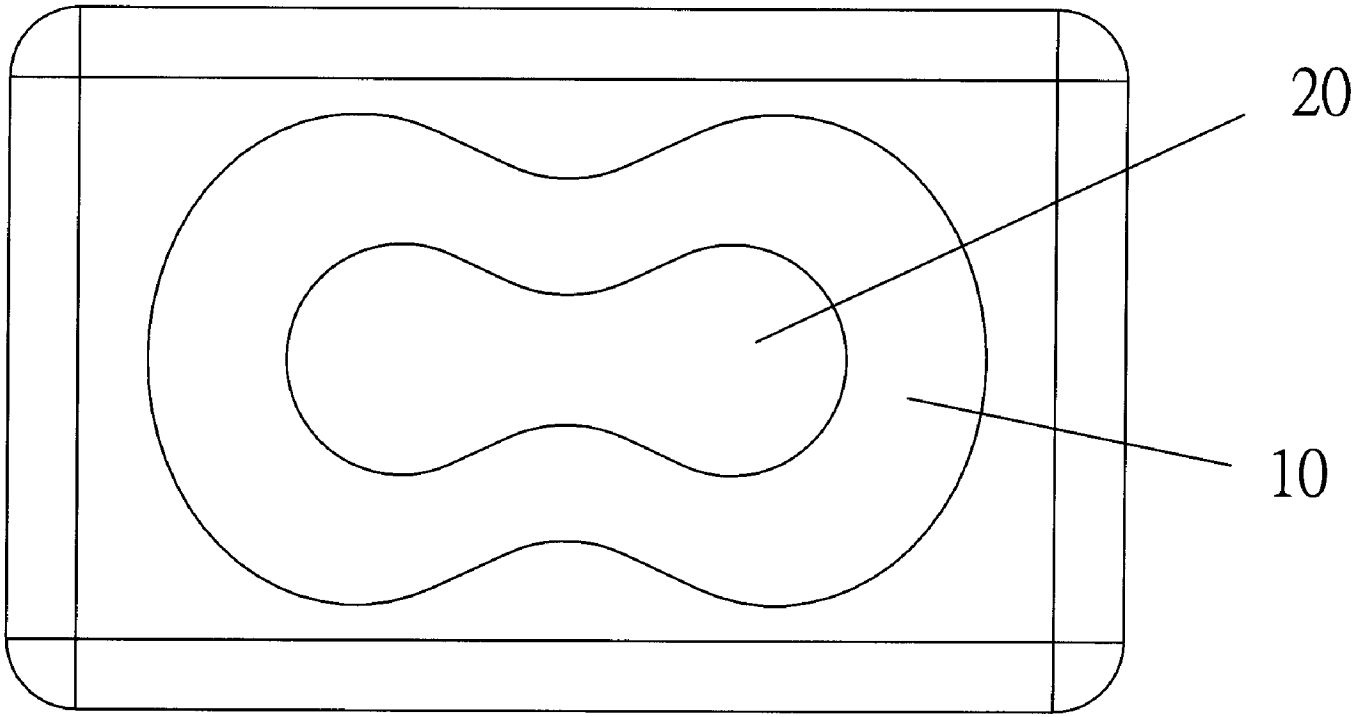
FIG. 2 is an elevational view of the present invention.

Referring to FIGS. 1 and 2, the multi-functional yoga brick 100 of the present invention is illustrated. A middle section of the brick is formed with a holding portion 10 which has a shape of "8". The holding portion 10 has a through hole 20 and two different layers 30.

Figure 3:
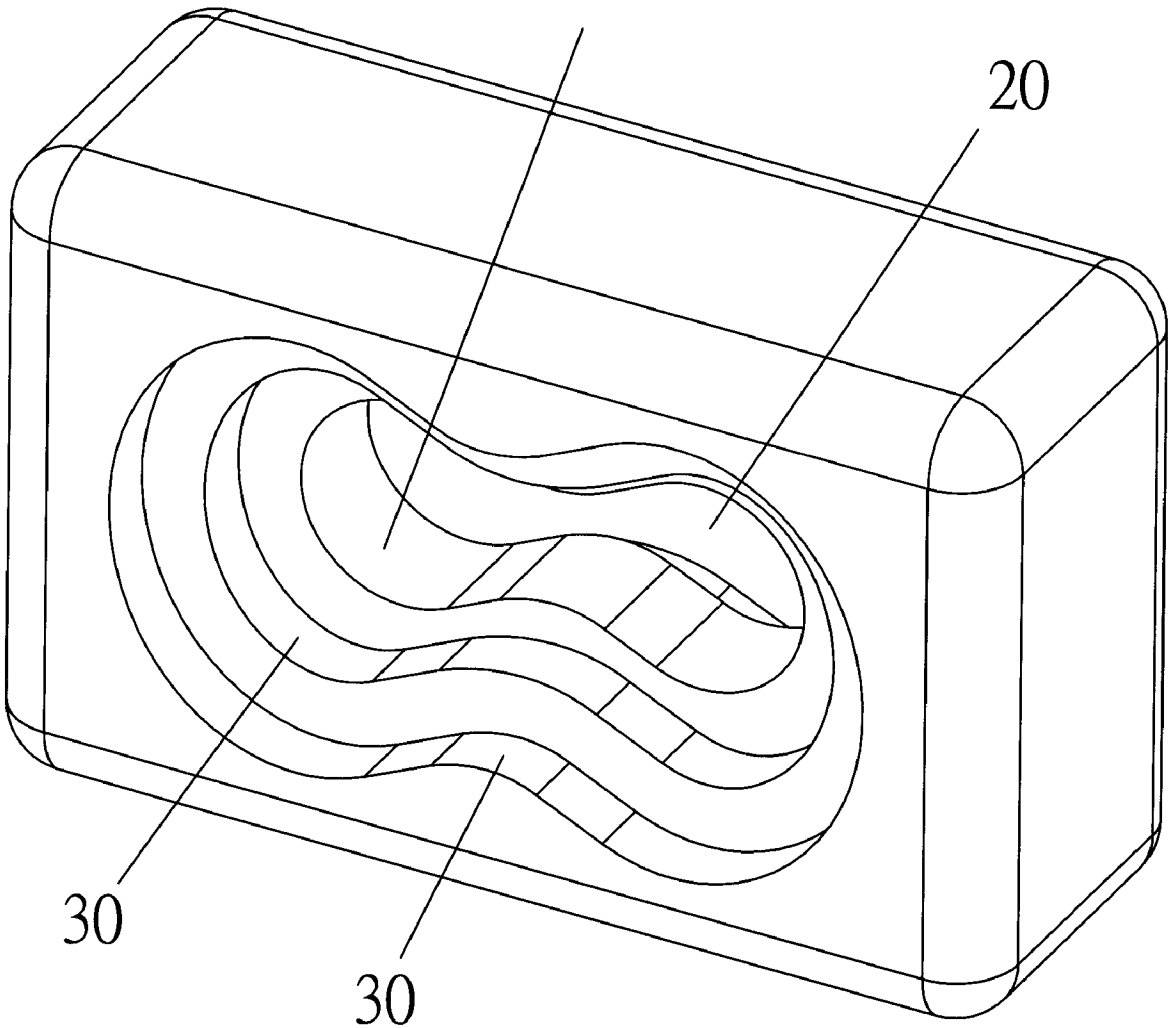
FIG. 3 is a schematic view showing another embodiment of the present invention.
Figure 4:
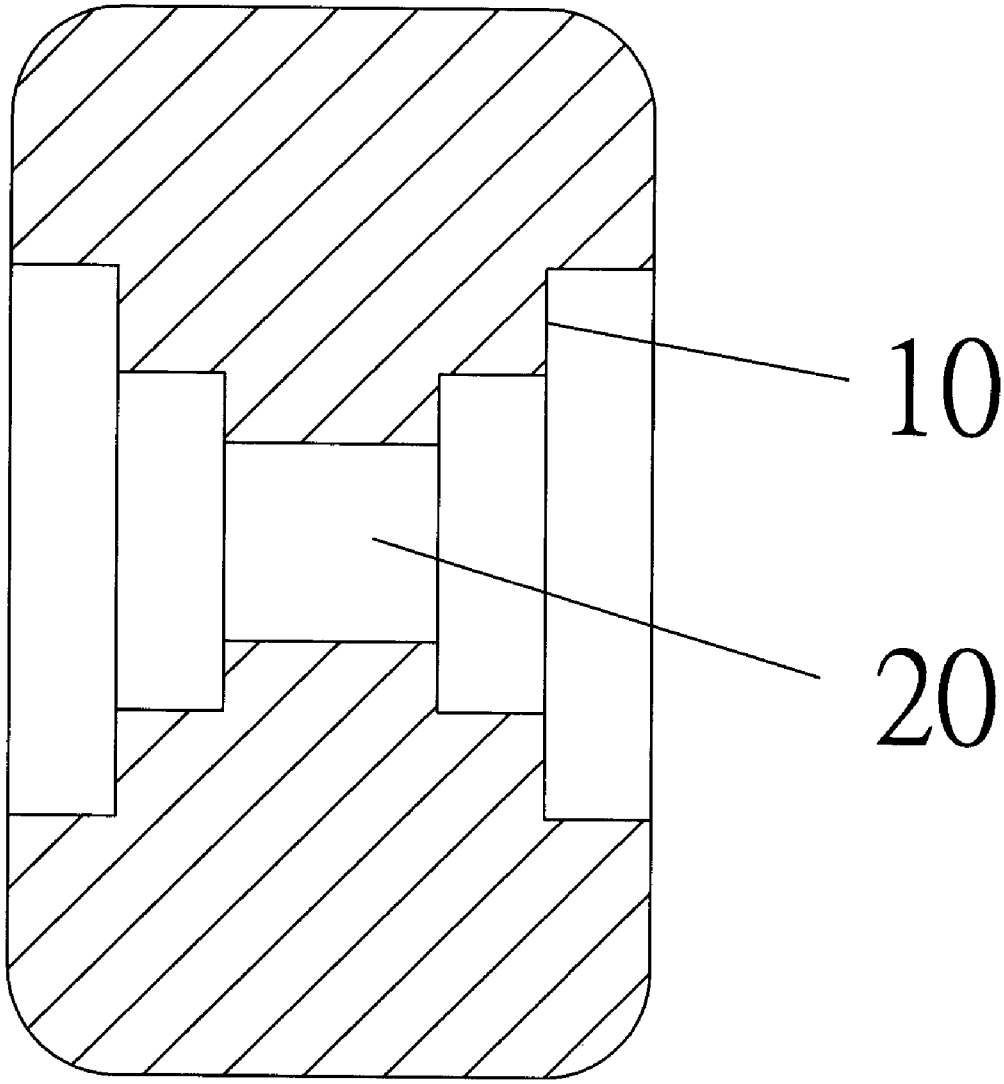
FIG. 4 is a cross sectional view of another embodiment of the present invention.

Referring to FIGS. 3 and 4, the multi-functional yoga brick of the present invention has a multi-sectional holding portion 10 at a middle section thereof. The holding portion 10 has a through hole 20 and an interior of the through hole 20 is formed with three layers 30.

Figure 5:
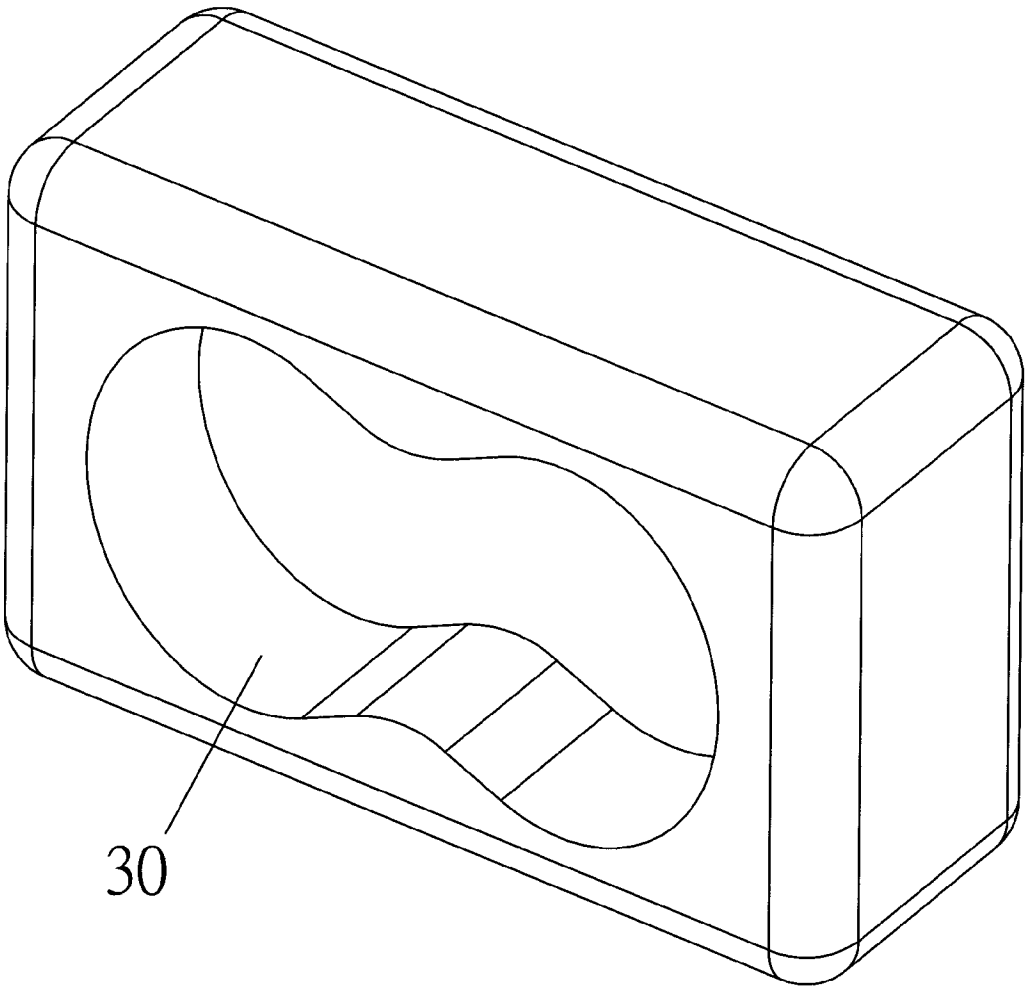
FIG. 5 is a schematic view about a further embodiment of the present invention.
Figure 6:
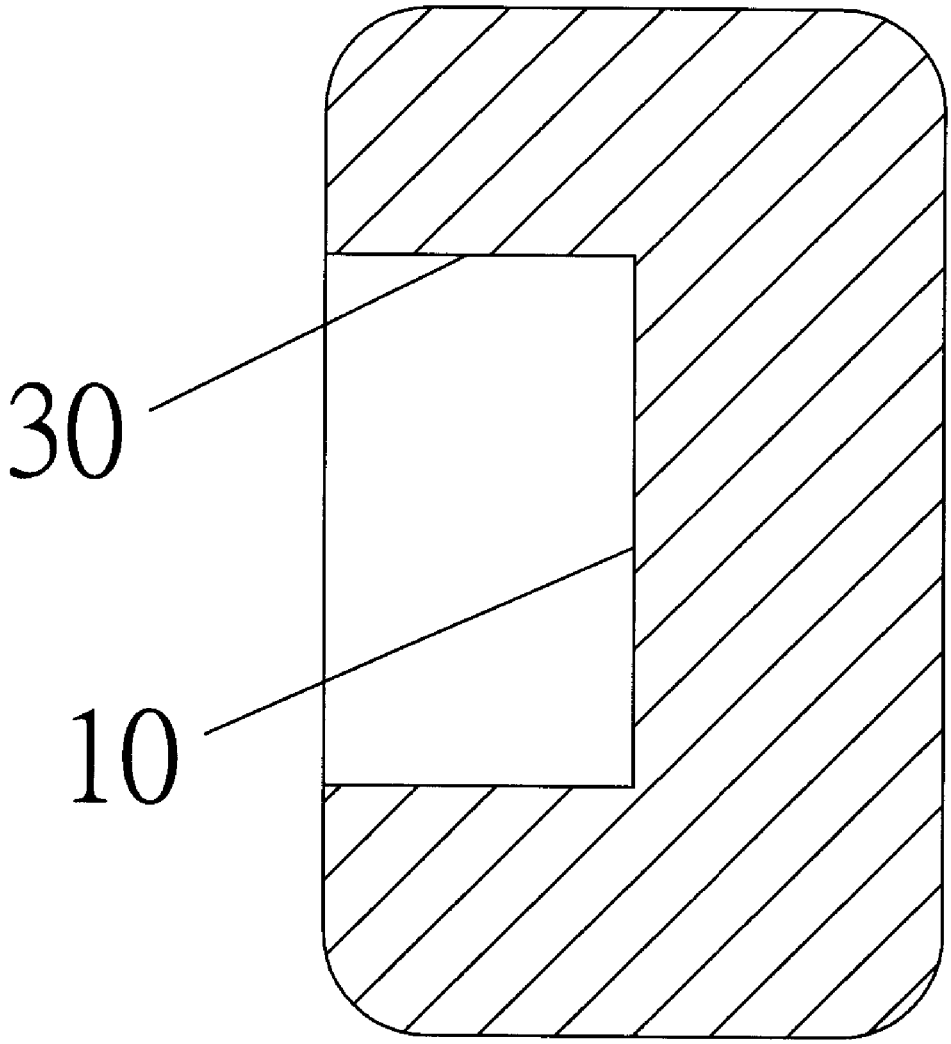
FIG. 6 is a cross sectional view about the further embodiment.

With referring to FIGS. 5 and 6, it is illustrated that the multi-functional yoga brick of the present invention has a multi-sectional holding portion 10 at a middle section thereof. The holding portion 10 is formed with a single layered recess 30 which does not penetrate through the brick.

Figure 7:
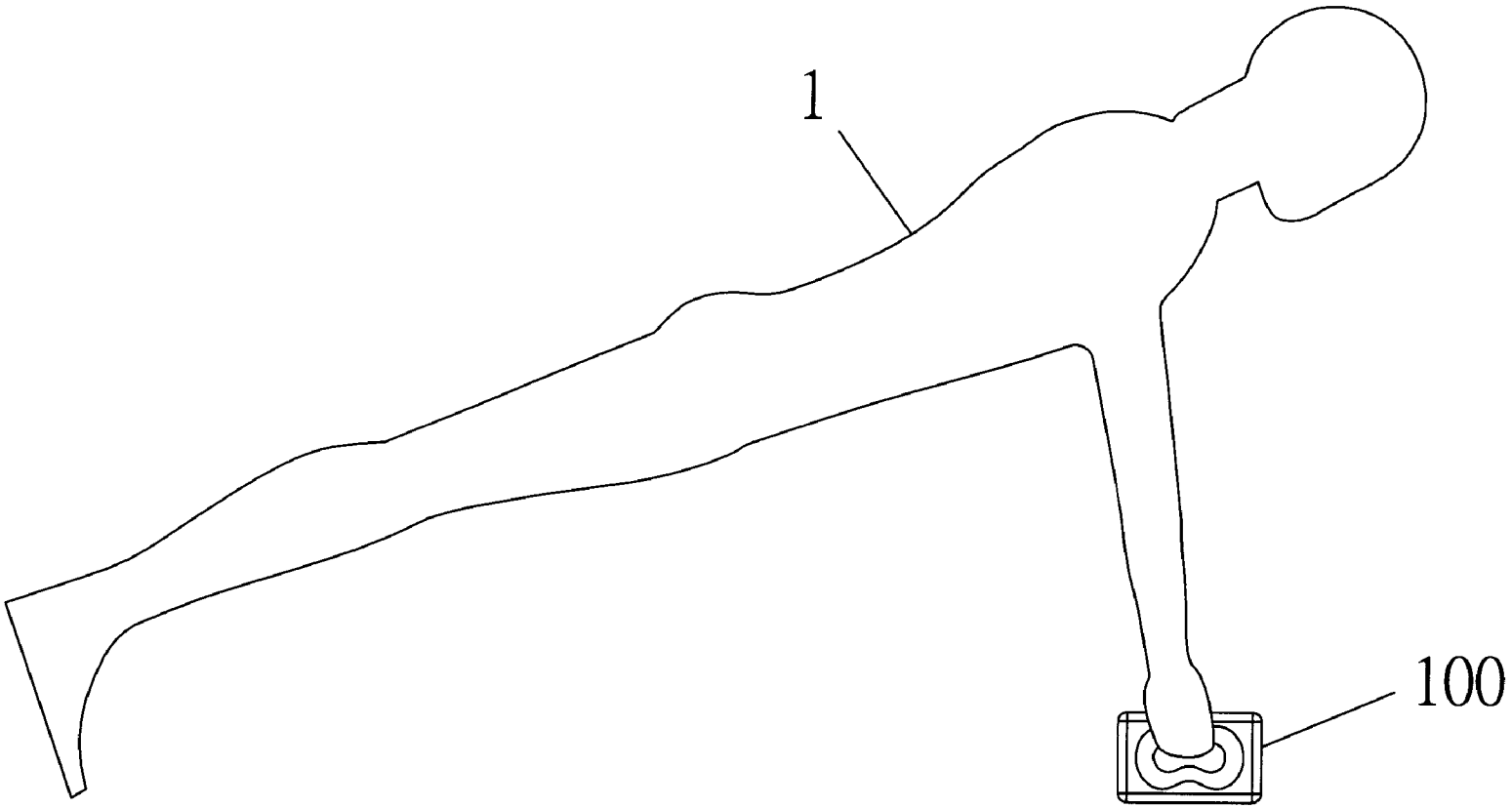
FIG. 7 shows the use of the present invention.
Figure 8:
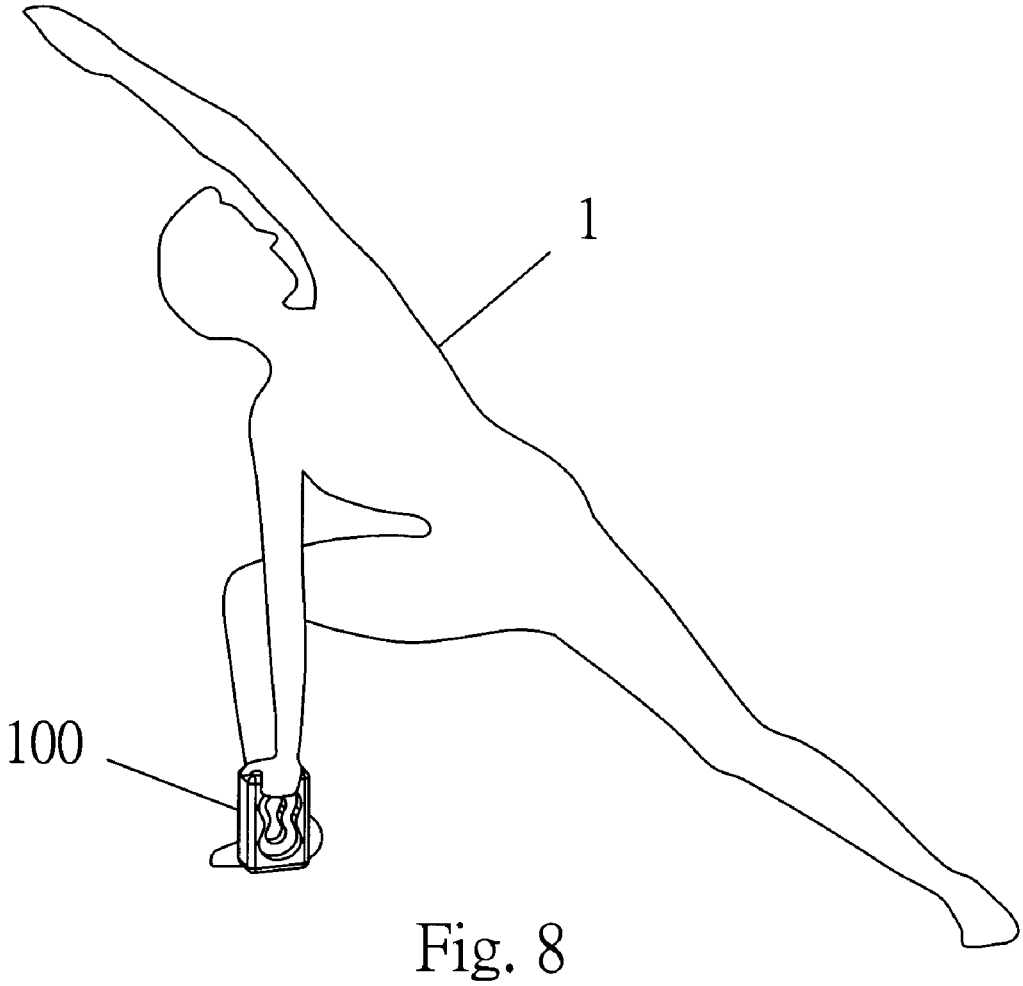
FIG. 8 shows another use of the present invention.
Figure 9:
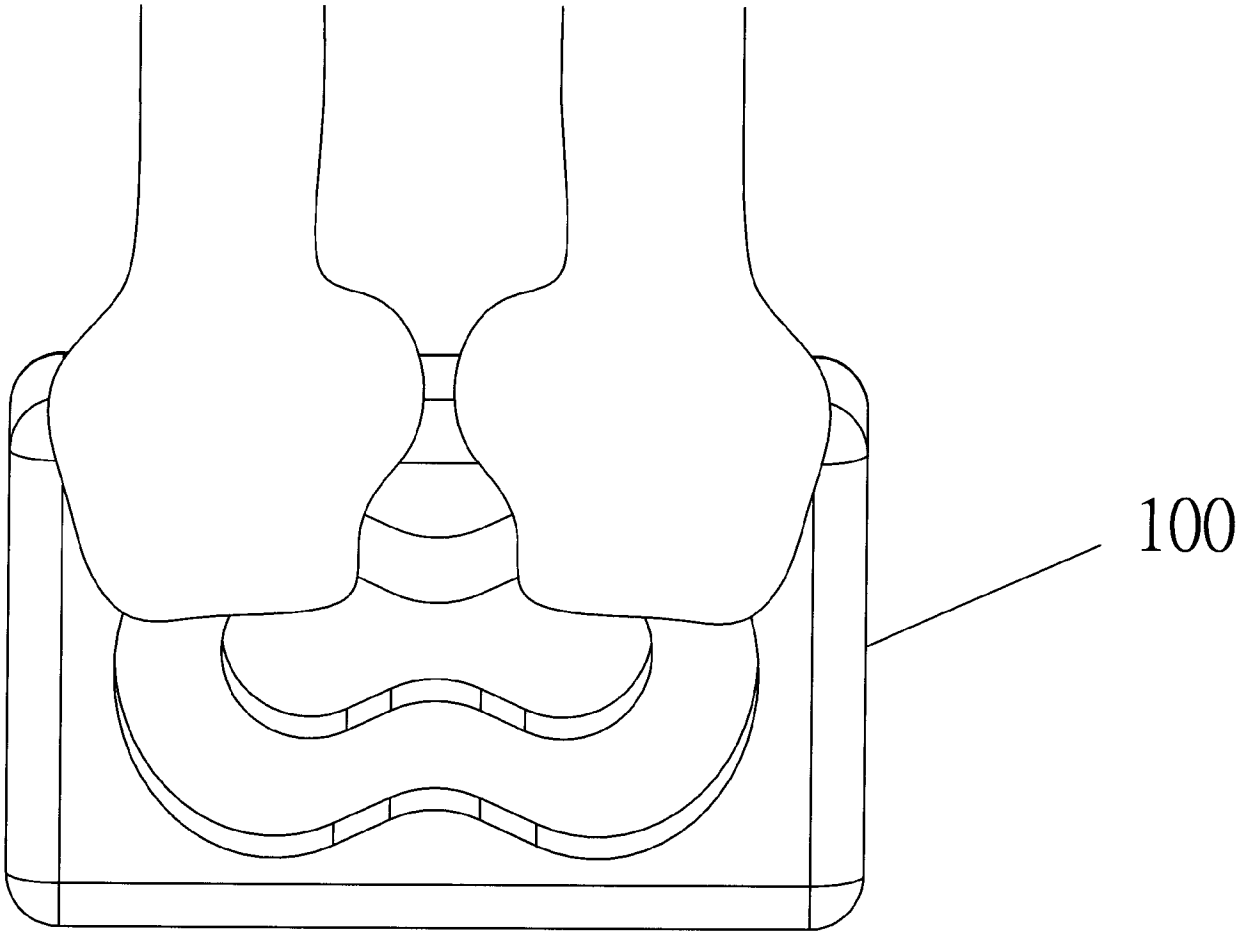
FIG. 9 shows the holding state of the present invention.
Figure 10:
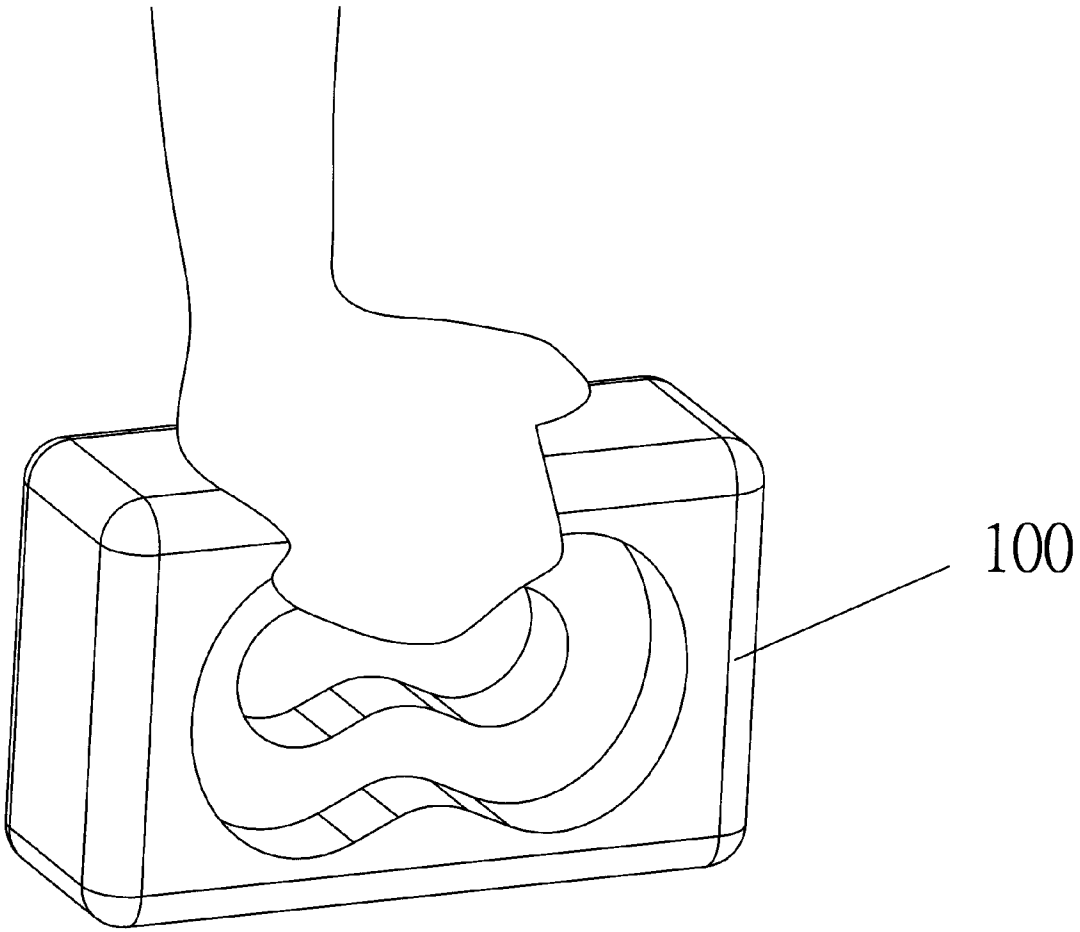
FIG. 10 shows another holding state of the present invention.
Figure 11:
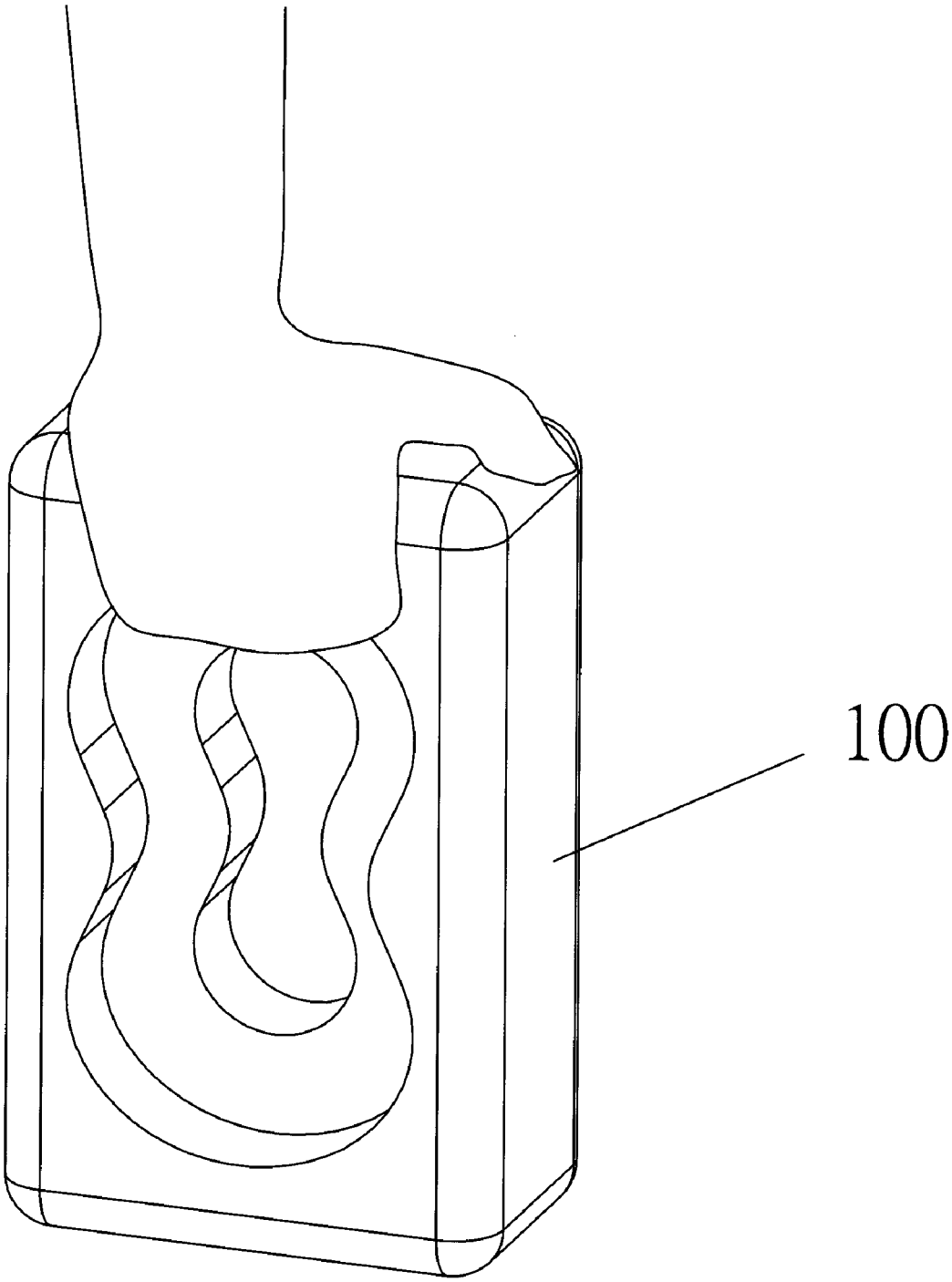
FIG. 11 shows a further holding state of the present invention.
Figure 12:
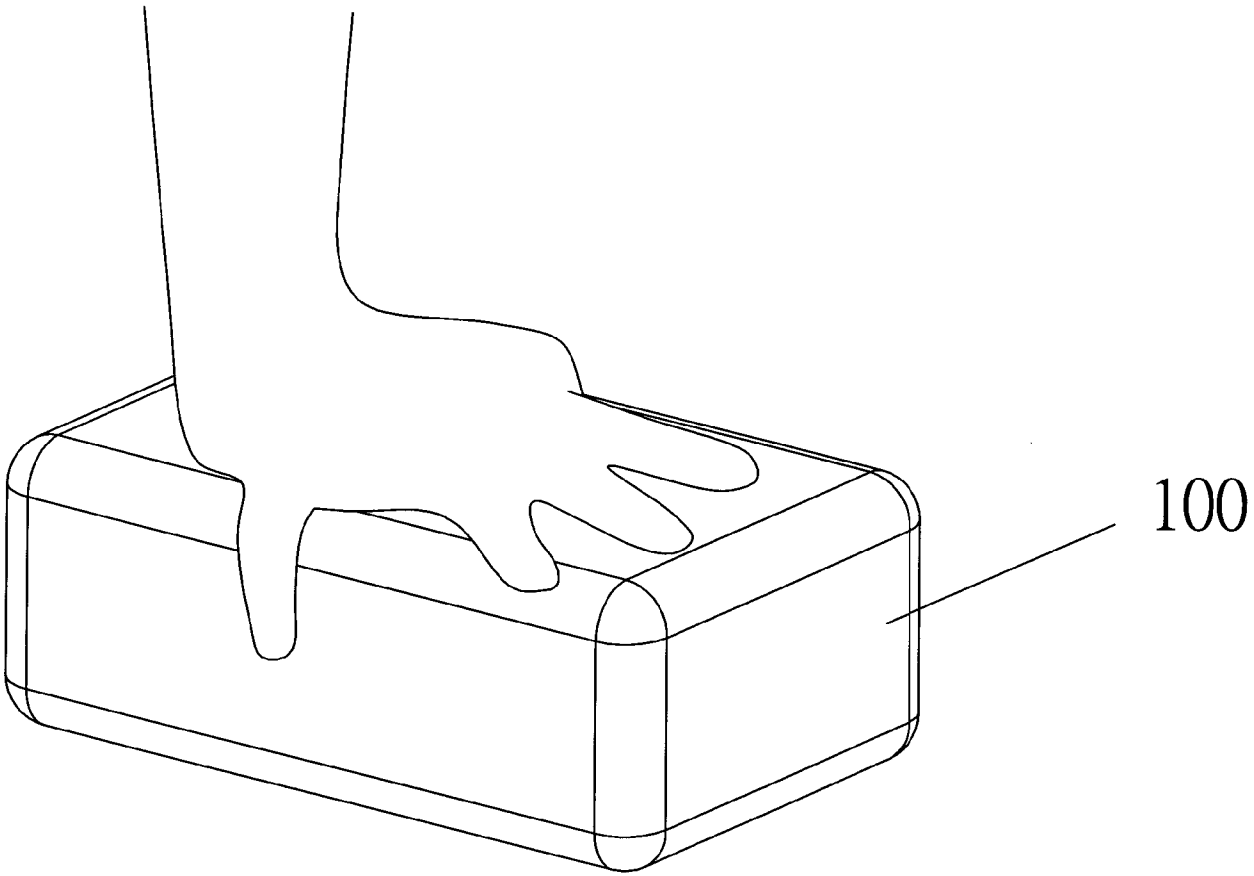
FIG. 12 shows a yet holding state of the present invention.
Figure 13:
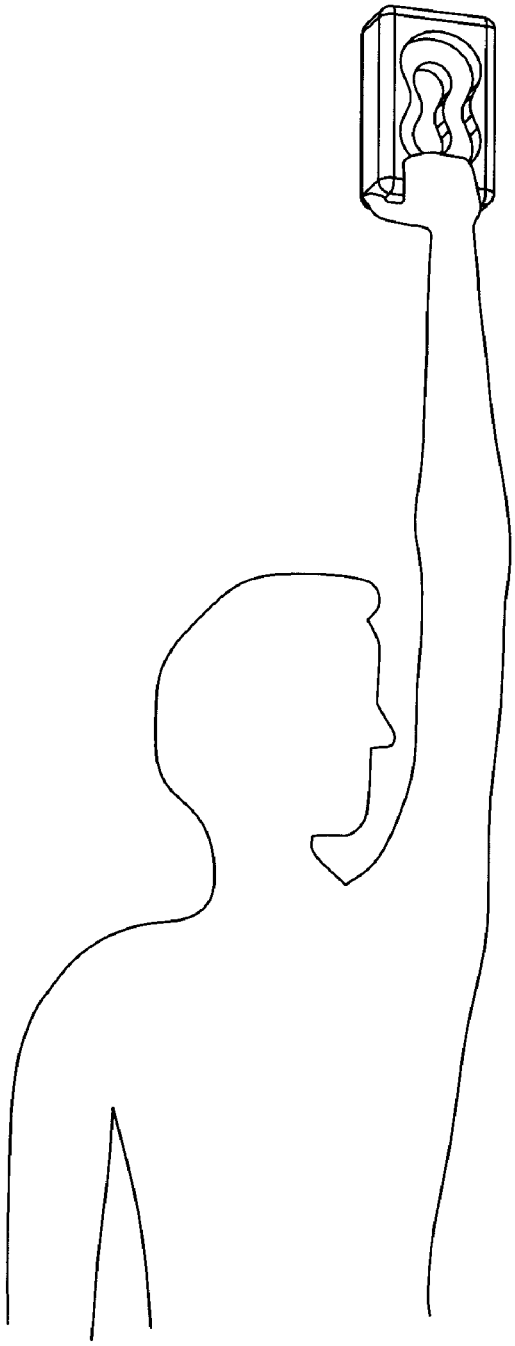
FIG. 13 shows that the present invention is lifted upwards.
Figure 14:
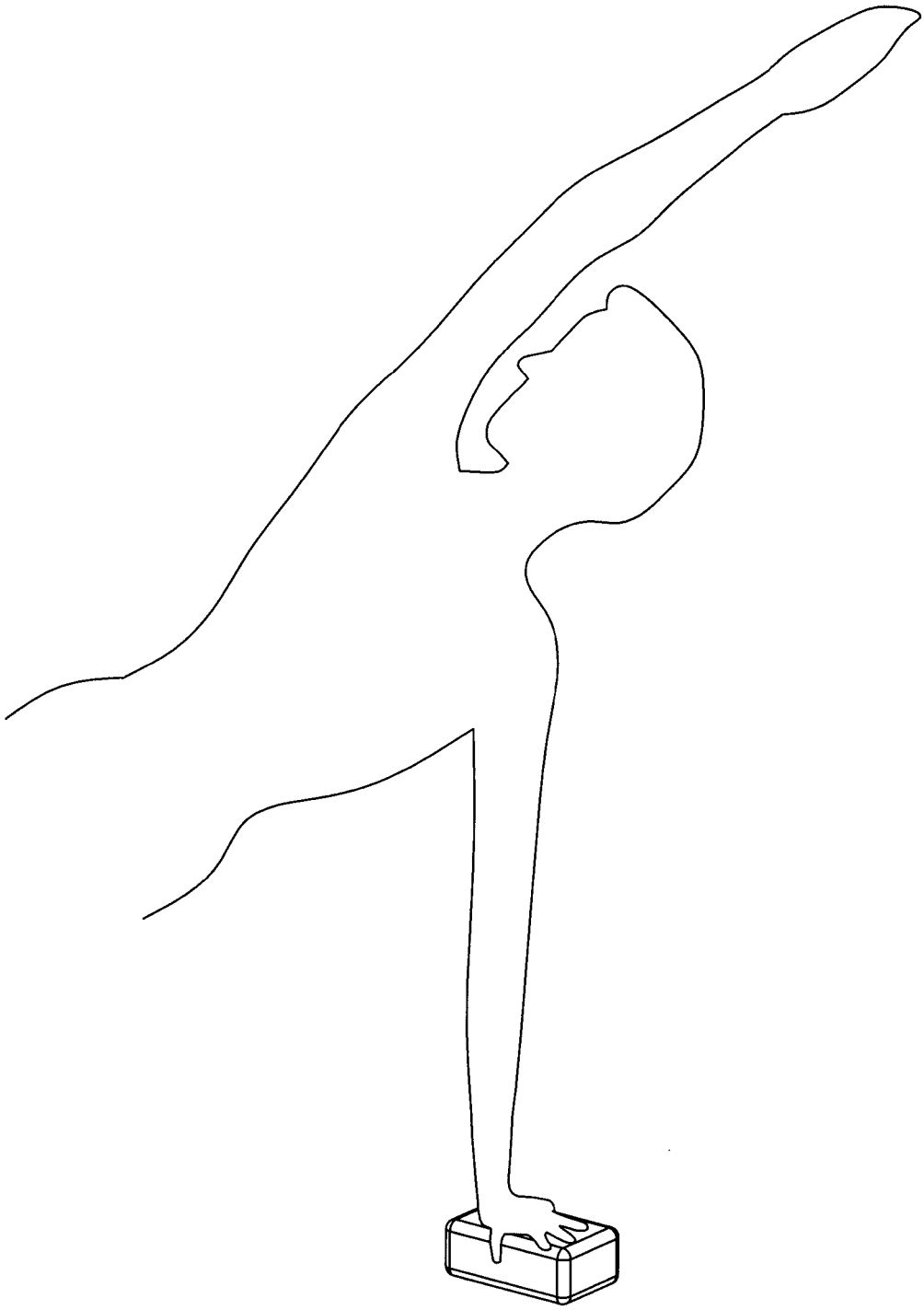
FIG. 14 shows that the present invention can be used to expand the body of the user.
Figure 15:
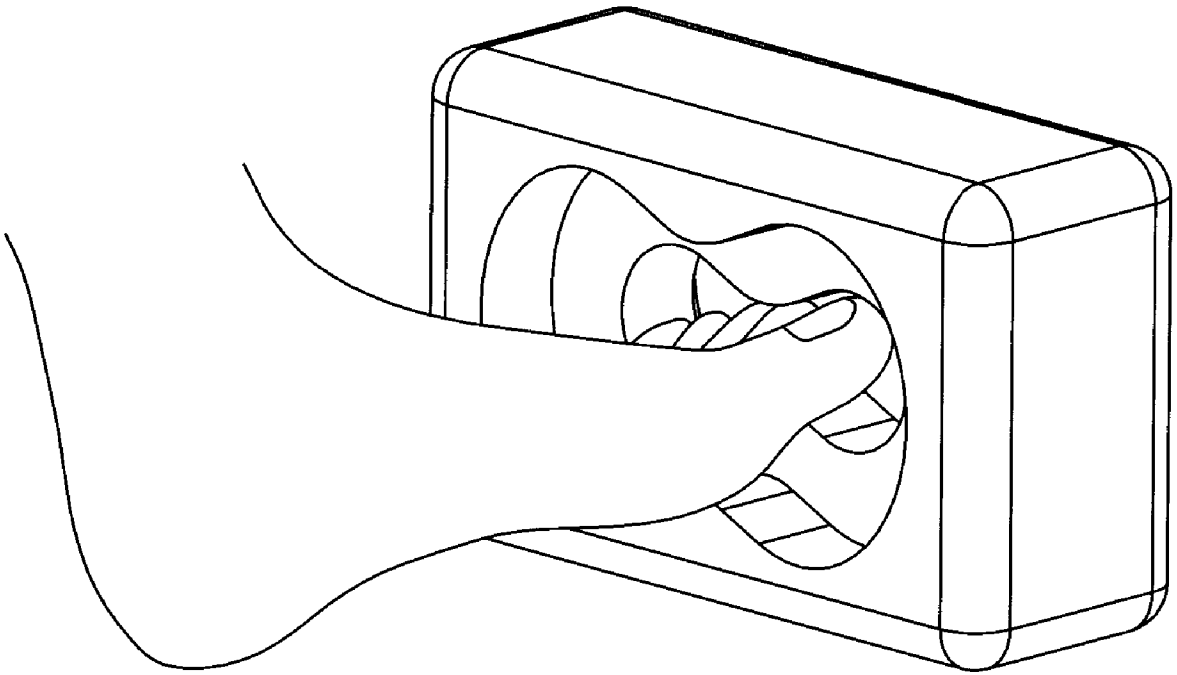
FIG. 15 shows that the toes of user can enter into the brick of the present invention.

With referring to FIGS. 7 and 8, the multi-functional yoga brick of the present invention is used to help the yoga exercise for fixing and balancing the body. When users make yoga exercise, the multi-functional yoga brick 100 of the present invention can be used as a supporter for causing the user to retain at a fixed pose. Thus the user has a better supporter and can expand the body effectively.

Figure 16:
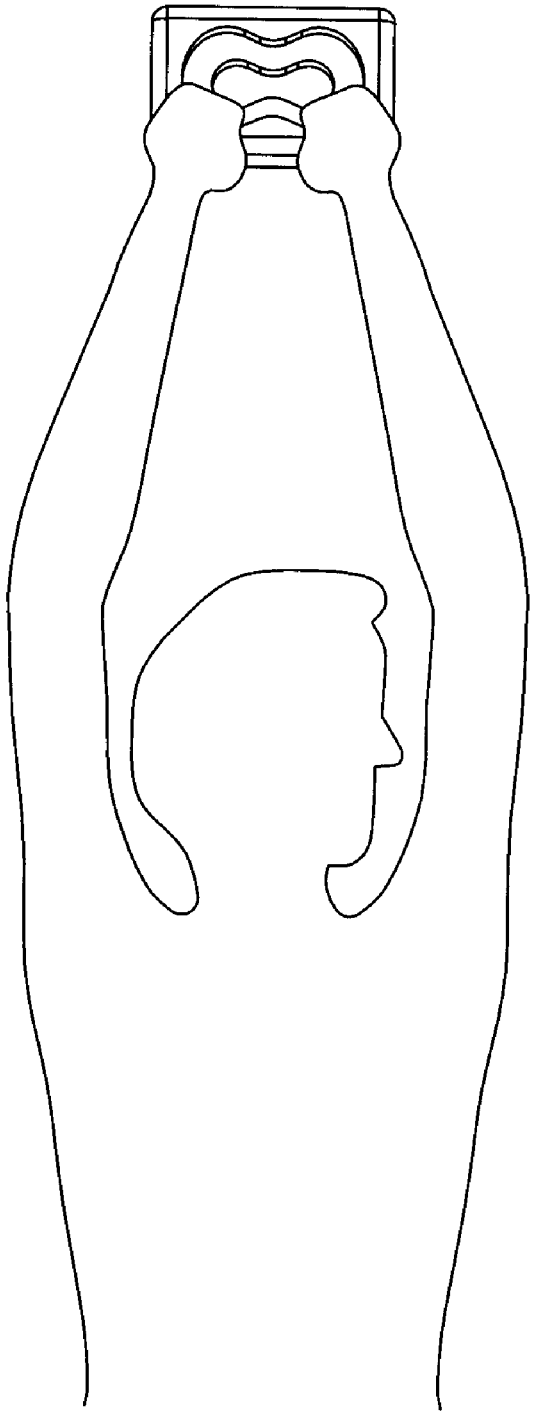
FIG. 16 shows that the two hands of the user can hold the brick of the present invention for expanding the arms and muscles.

With referring to FIGS. 9 to 16, in the multi-functional yoga brick 100 of the present invention, the user can hold the multi-functional yoga brick by a single hand (referring to FIG. 9) or by two hands (referring to FIG. 10), or holds the brick at an upper lateral side (see FIG. 11), or holds the brick from a lateral side (see FIG. 12), or lifts the brick by single one hand or by two hands (see FIG. 13), or presses by one hand for expanding the body; the toes can enter into the brick (referring to FIG. 15), or the brick is held by two handles for expanding the arms and muscles (see FIG. 16).

In the present invention, the multi-functional yoga brick is an elastic body. Or the multi-functional yoga brick is made of elastic plastics or rubber or injected plastic material, or the holding portion has a shape of "8", or a round shape or an elliptical shape.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multi-functional yoga brick, comprising:

a cubic brick body;

a hollow through hole penetrating through two opposite sides of the brick body and comprising a middle section in between the two opposite sides;

a cross section of the through hole having a figure eight shape;

wherein an inner wall of the through hole is formed as a stepped wall (10);

the middle section of the through hole being smaller than two openings at the two opposite sides of the through hole; and having two steps from the middle section of the through hole to any one of the two openings of the through hole.

2. The multi-functional yoga brick as claimed in claim 1, wherein the multi-functional yoga brick is an elastic body.

3. The multi-functional yoga brick as claimed in claim 1, wherein the multi-functional yoga brick is made of elastic plastics or rubber or injected plastic material.

* * * * *